United States Patent [19]

Plath

[11] Patent Number: 4,693,092

[45] Date of Patent: Sep. 15, 1987

[54] KNITTING MACHINE

[75] Inventor: Ernst-Dieter Plath, Tailfingen, Fed. Rep. of Germany

[73] Assignee: Sipra Patententwicklungs-und Beteiligungs-Gesellschaft mbH, Tailfingen, Fed. Rep. of Germany

[21] Appl. No.: 775,256

[22] Filed: Sep. 11, 1985

[30] Foreign Application Priority Data

Sep. 11, 1984 [DE] Fed. Rep. of Germany ..... 3433290

[51] Int. Cl.[4] ..... D04B 15/32; D04B 15/06; D04B 15/24

[52] U.S. Cl. ..... 66/55; 66/104; 66/106

[58] Field of Search ..... 66/54, 55, 104, 106, 66/107, 8

[56] References Cited

U.S. PATENT DOCUMENTS

| | | | |
|---|---|---|---|
| 2,070,458 | 2/1937 | Steere | 66/8 |
| 2,090,500 | 8/1937 | Lawson | 66/107 |
| 2,123,534 | 7/1938 | Lawson et al. | 66/54 X |
| 2,617,282 | 11/1952 | Reichert | 66/54 X |
| 2,893,227 | 7/1959 | St. Pierre | 66/107 |
| 4,180,993 | 1/1980 | Philip | 66/107 |
| 4,532,781 | 8/1985 | Buck | 66/104 |
| 4,546,623 | 10/1985 | Kuhn et al. | 66/104 |

FOREIGN PATENT DOCUMENTS

| | | | |
|---|---|---|---|
| 3311361 | 10/1984 | Fed. Rep. of Germany . | |
| 2137233 | 10/1984 | United Kingdom | 66/104 |

*Primary Examiner*—Wm. Carter Reynolds
*Attorney, Agent, or Firm*—Michael J. Striker

[57] ABSTRACT

In a knitting machine with longitudinally movable latch members and sinkers which are pivotable and longitudinally movable in the same direction, sinker-controlling cams and needle controlling cams are arranged on individual cam supports which are adjustable relative to each other in a longitudinal direction and transverse direction. Adjustable loop-sinking cams are provided in a sinker cam ring or a needle cam ring.

6 Claims, 7 Drawing Figures

KNITTING MACHINE

BACKGROUND OF THE INVENTION

The present invention relates to a knitting machine with longitudinally displaceable latch needles and sinkers also longitudinally displaceable in the same direction and also pivotable.

In the knitting machine of the foregoing type the sinkers which are of small construction length are mounted in a sinker support which is stationary relative to the needle support, and the cams for the sinkers as well as the cams for the latch needles are constructed so that the sinkers during the drawing-off motion of the respective needles are longitudinally moved in the opposite direction at least in certain regions.

It has been known that in order to facilitate the movement of the needles and sinkers in the opposite directions during the knitting of a knitware wherein the control curves for the needles and sinkers must be maintained less steep so that the machine would be able to operate faster without a danger of the needle or thread rupture. It has been already proposed in the knitting machines of the type under discussion to move the sinkers and needles in the same direction, whereby the machine with a clear loop-formation area is obtained and the sinkers are formed with the length which is small as compared to the length of the needles The sinkers should be positioned between the guiding webs to reduce wear. The above described arrangement has been disclosed in DE-OS No. 3,311,361 corresponding to U.S. pending application Ser. No. 594,771. However, with a quickly-running knitting machine in addition to the problem of intensive wear of the needles and the sinkers as well as the controlling cams, threads are subject to high loads during the loop-sinking process.

SUMMARY OF THE INVENTION

It is an object of the present invention to provide an improved circular knitting machine.

It is another object of the invention to reduce loading of a thread and adjust it to various qualities of the thread.

These and other objects of the invention are attained by a knitting machine comprising longitudinally movable latch needles; sinkers longitudinally movable in the same direction as that of said latch needles and pivotable; a sinker support; a needle support, said sinkers being of a small structural length and being positioned in said sinker support stationarily relative to said needle support; sinker controlling cams and latch needle controlling cams arranged so that said sinkers during a draw-off movement of respective needles are longitudinally moved in an opposite direction at least in zones; adjustable cam supports, said sinker controlling cams and said needle controlling cams being arranged in said cam supports to obtain a predetermined constellation of a needle movement curve and a sinker movement curve in said longitudinal direction of the sinkers and the needles (12) and also traversely to said longitudinal direction of said adjustable cam supports; said cams for said sinkers and said latch needles additionally having loop-sinking cams adjustable relative to said cam supports, said cams being arranged such that the needle movement curve and said sinker movement curve at an end portion of a counter movement, have coinciding loop-sinking points in a direction of running.

It has been basically known that the knitting toolcarriers should be adjusted relative to each other so that with the circular knitting machines having two-row needles a change in a mesh length should be maintained to obtain an after-loop sinking. With specific conventional machines, in order to obtain the longitudinal movement of the needles and the sinkers in the opposite directions in the region of the loop sinking, the thread must pass through a small number of the needles and sinkers whereby a substantial unloading of the thread is obtained. It has been shown that for the majority of yarns an optional loopsinking relationship results when the loop-sinking points of the sinker movement curve and the needle movement curve lie at the same vertical level in the direction of running.

In accordance with another feature of the invention the latch needles may have at least one leg operative in a draw-off direction and another leg which controls a draw-off motion of a needle.

A distance of an intersection point of said curves from said loop-sinking points to deflection points formed by said loop-sinking points correspond to at most a double distance (needle spacing T) between two neighboring needles.

The needle movement curve and the sinker movement curve may run at said sinking points over at most two needle spacings parallel to each other.

The loop-sinking points in a driving direction of the needle movement curve and said sinker movement curve may be precisely superposed.

The sinker movement curve may have within a range of a longitudinal movement in an opposite direction relative to a needle movement curve a smaller maximal pitch angle ($\alpha$) to a horizontal than that of said needle movement curve.

The central position of the loop-sinking points of the needles and the sinkers as well as an individual adjustment of the cams are very important and advantageous. Due to the transversal movement of the cam supports the sinking points of the needles and the sinkers are displaceable relative to each other. Various means for an individual adjustment of the cams can be provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
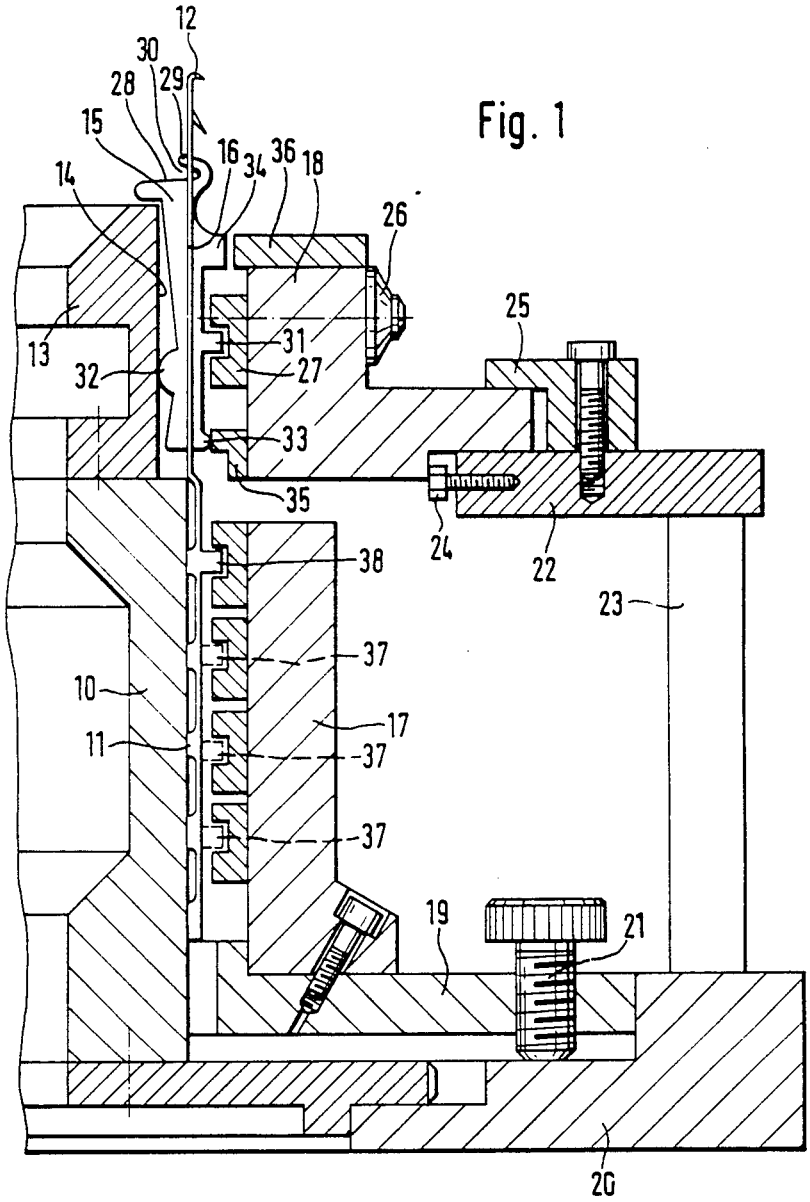
FIG. 1 is a fragmentary sectional view through a needle cylinder, coaxial sinker cylinder and a cylinder cam for needles and sinkers of a circular knitting machine.

Referring now to the drawings in detail, and firstly to FIG. 1 thereof, it will be seen that the circular knitting machine of the invention includes a needle cylinder 10 which is formed as a carrier for individual needles which has axis-parallel receiving grooves for shafts 11 of latch needles 12. Above the needle cylinder and coaxially thereto, is provided a sinker cylinder 13 which is rigidly connected to the needle cylinder 10. This sinker cylinder 13 is provided with axis-parallel grooves 14 which receive sinkers 15 longitudinally displaceable to the interstices of the latch needles 12 and pivotably mounted.

The latch needles 12 each has a shaft portion or projection 16 which extends over the total height of the sinker cylinder 13 between individual sinkers 15. The cam rings for the latch needles 12 are arranged on a needle cam ring 17 whereas the control cams are positioned on a sinker cam ring 18.

The needle cam ring 17 is positioned on a supporting ring 19 which is mounted to a machine frame 20 and is vertically adjustable, as schematically shown in FIG. 1, by means of an adjusting bolt 21 which due to its rotation will vary stitch length. The sinker cam ring 18 rests on a supporting ring 22 which is anchored by a number of columns 23, uniformly spaced from each other over the circumference of the circular knitting machine, to the machine frame 20. The sinker cam ring 18 is adjustable in the circumferential direction on the supporting ring 22. The adjustment device is not shown, however. FIG. 1 illustrates bolts 24 anchored in the supporting plate 22 for centering the sinker cam ring 18 and a clamping member 25 by which the sinker cam ring 18 is secured in an adjusted position on the supporting ring 22.

FIG. 1 further shows an adjusting disc 26, by means of which a loop forming cam ring 27 for sinkers 15 is adjustable in the known fashion. In other words, rotation of adjusting disc 26 will vary stitch length. The sinkers 15 are formed as clearing-the-loop or knocking-over sinkers and have a loop-forming edge 28 by which an insertion nose or projection 29 is lifted at its end, with the formation of a sinker throat 30 for the thread being processed. Each sinker 15 is provided for the longitudinal displacement thereof with a control leg 31. The pivotal motion of the sinker 15 about a support pivot point 32 in a guiding groove 14 is effected by means of two feet or legs 33 and 34 which cooperate respectively with pressure cams 35 and 36.

The latch needles 12 are provided at their shafts 11 with backing-off or moving-away butts 37 and needle butts 38, wherein each moving-away or driving-away butt 37 can be arranged in a different position regarding the orientation thereof relative to the various needle-cam-control steps (39-42) as will be further explained with reference to FIGS. 2 through 6.

FIGS. 2 to 6 illustrate the cams for controlling the sinkers 15 (the upper portion of each figure) and for controlling the latch needles 12 (the lower portion of each figure). Both pressure cams 35 and 36 of the sinker cam as well as the cams utilized for controlling the leg 31 of the sinker 15 are shown. Four control steps or stages 39, 40, 41 and 42 (FIG. 2) formed by the interchangeable cams of the needle cam ring of the system are shown. According to FIGS. 2-6 various possibilities of the adjustment of individual loop formations can be provided.

Figure 2:
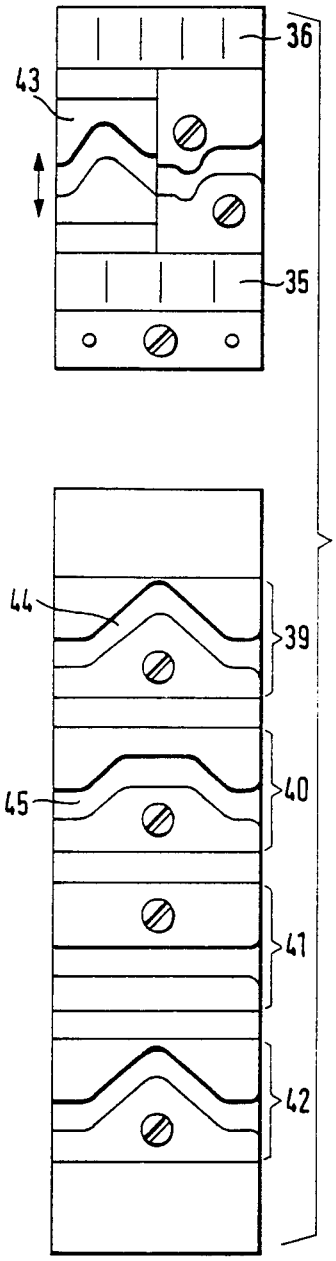
FIG. 2 is a top view of the cams of the two separated cam rings of the knitting machine, according to a first embodiment.

In the embodiment of FIG. 2, a draw-off cam 43 is provided, which is adjustable in the directions of the double arrow whereas needles 12 are controlled only by non-adjustable cams. The latch needles 12, the control butt of each of which is positioned vertically at the level of the control step 39, are moved out due to the control curve 44 to the full knitting position. The needles, the control butt 37 of which is positioned at the level of the control curve 40 are moved out due to the control curve 45 only to the tuck position whereas the needles, the control butt of which is located vertically at the level of the control curve 41, remain in the circular position. The control step 42 of FIG. 2 corresponds to the control step 39.

The above described arrangement of the cam surfaces has the advantage that the needles always pass through the same control curves and its latching stroke remains continuous, and during the adjustment of the loop sinking, no after-adjustment of the thread guide is required. The central adjustment of the loop sinking is not influenced by the lifting and sinking of the needle cam ring 17.

Figure 3:
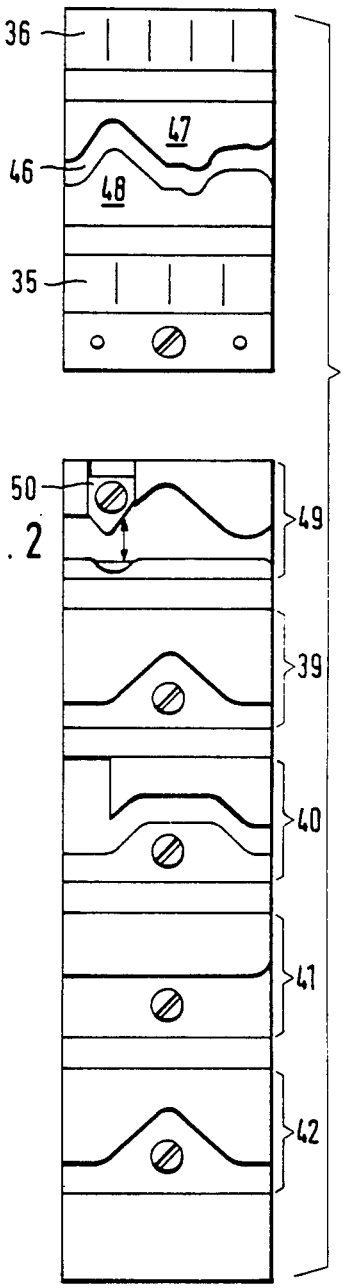
FIG. 3 is a top view of the cams of the two cam rings according to a second embodiment.

In the embodiment of FIG. 3, the sinker cam remains unchanged. The guide curve 46 for the sinker leg 31 is formed between the stationary cams 47 and 48. The individual adjustment of the loop sinking takes places on the needles which are all provided with additional loop-sinking butt 38 which is influenced by an additional cam step or stage 49 in which an adjustable loop-sinking cam 50 is formed. In this embodiment only the smallest transitions in the sinker control curve are obtained, which favorably affects wear reduction of the sinkers 15.

Figure 4:
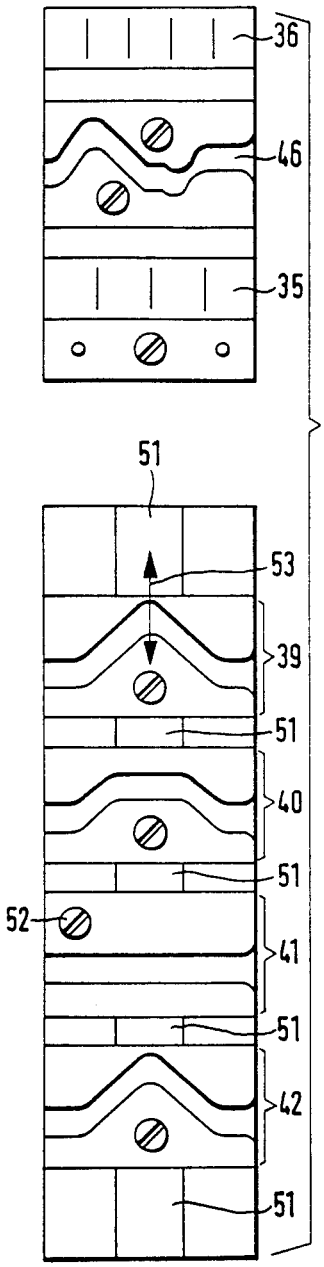
FIG. 4 is a top view of the cams of the two cam rings according to the third embodiment.

In the embodiment of FIG. 4. the sinker cam is formed similarly to that of FIG. 3. Interchangeable cams of the control steps 39, 40 and 42 in the needle cam are set in the direction of a strip 51, which is adjustable in the directions of a double arrow 53, and are commonly adjustable upon the change of the loop-sinking position. The cams of the control stage 41 for the circular guiding are not secured to the strip 51 as indicated by a lateral position of the fastening screws 52.

Figure 5:
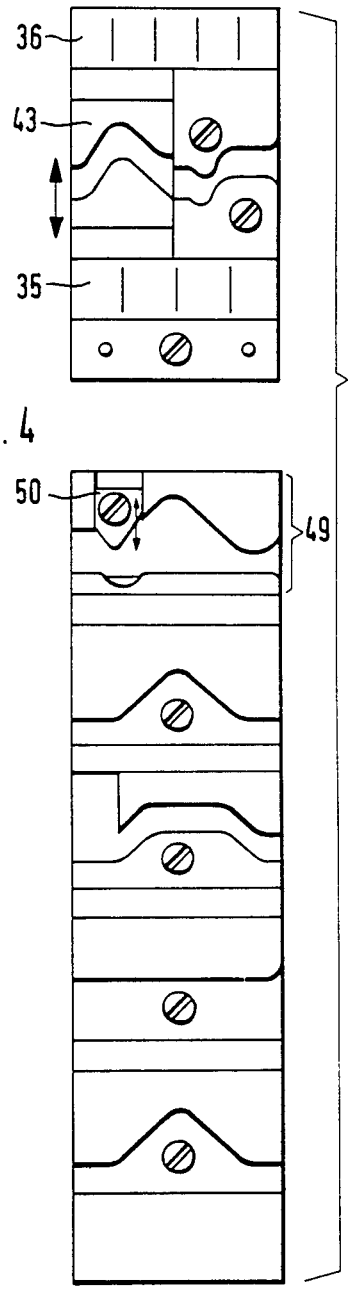
FIG. 5 is a top view of the cams of the two cam rings according to a third embodiment.

FIG. 5 depicts the embodiment in which the sinker cams of the embodiment of FIG. 2 are combined with the needle cams of the embodiment of FIG. 3, and the adjustable cam 43 in the sinker cam system as well as the adjustable cam 50 in the needle cam system are provided.

Figure 6:
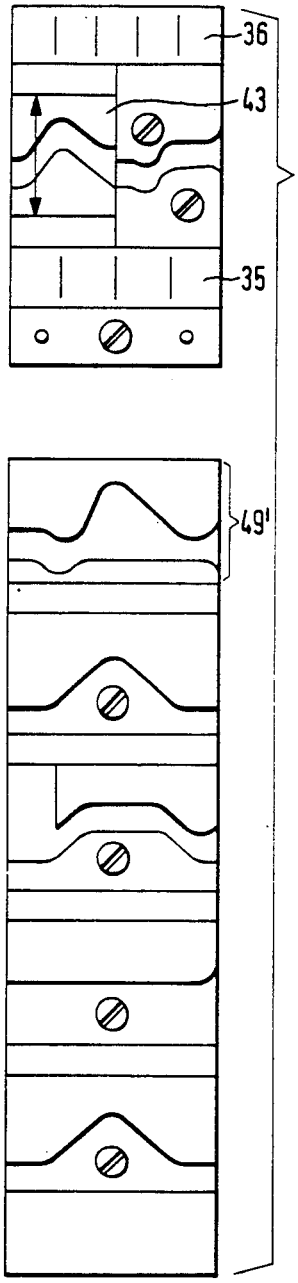
FIG. 6 is a top view of the cams of the two cam rings according to a fourth embodiment.

FIG. 6 illustrates yet another embodiment of the invention, in which the adjustable loop-sinking cam 43 of the sinker cam system according to FIG. 2 and the stationary needle cam are provided, whereby the cam 49', which controls the loop-sinking leg of each latch needle 12, is non-adjustable.

Figure 7:
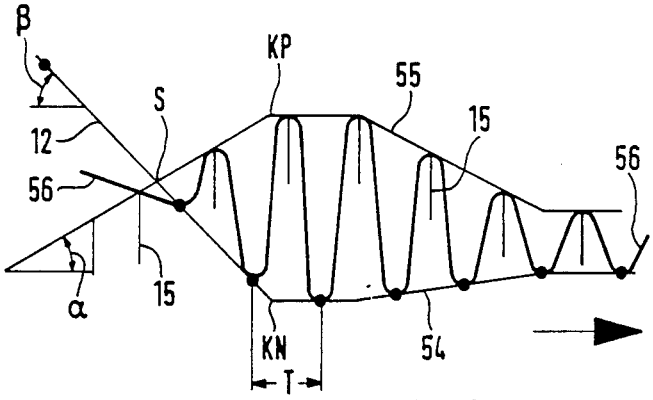
FIG. 7 is a view of the needle movement curve and the sinker movement curve of the circular knitting machine.

FIG. 7 shows a needle movement curve 54 and a sinker movement curve 55 in the region of the loop-sinking. The intersection of both curves is denoted by reference S while the sinking points of the needle movement curve 54 and sinker movement curve 55 are designated by KN and KP, respectively. The adjacent needles spaced from each other at a distance T are denoted by individual points and adjacent sinkers 15 which spaced from each other by distance T are denoted by dashes. The thread 56 engaged by needles 12 and sinkers 15 passes through the needles and the sinkers. FIG. 7 illustrates both movement curves in a preferable constellation in which the loop-sinking points KN and KP of needles 12 and sinkers 15 precisely superimpose each other and thread 56 makes between the intersection S of the two curves and two sinking points KN and KP only three loops (about two needles and one sinker). The distance between the intersection point S and two loop-sinking points KN and KP is smaller than two needle spacings T. The pitch angle $\alpha$ of the sinker movement curve 55 for the loop-sinking point KP is smaller than the pitch angle $\beta$ of the needle movement curve 54. The needle movement curve 54 and the sinker movement curve 55 run from the loop-sinking points KN and KP over a path smaller than two needle spacings T, in parallel to each other.

It will be understood that each of the elements described above, or two or more together, may also find a useful application in other types of circular knitting machines differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A knitting machine comprising longitudinally movable latch needles; sinkers longitudinally movable in the same direction as that of said latch needles and pivotable; a sinker support; a needle support, said sinkers being of a small structural length and being positioned in said sinker support which is arranged stationarily relative to said needle support; sinker controlling cams and latch needle controlling cams arranged so that said sinkers during a draw movement of respective needles are longitudinally moved in an opposite direction at least in zones; individual cam supports (17, 18), said sinker controlling cams and said needle controlling cams being arranged on said cam supports, respectively, to obtain a predetermined constellation of a needle movement curve (54) and a sinker movement curve (55), said cam supports being adjustable relative to each other in a longitudinal direction of the sinkers (15) and the needles (12) and also traversely to said longitudinal direction; at least said cams for said sinkers and said latch needles additionally having loop-sinking cams (43, 50) adjustable relative to said cam supports (17, 18), said cams being arranged such that the needle movement curve and the sinker movement curve at an end portion of a counter movement have coinciding loop-sinking points (KN, KP) in a direction of running.

2. The machine as defined in claim 1, wherein said latch needles have each one needle butt (37) operative in a needle-clearing direction and another needle butt (38) which controls the draw motion of a needle.

3. The machine as defined in claim 2, wherein the sinker movement curve (55) has within a range of a longitudinal movement in an opposite direction relative to a needle movement curve a smaller maximal pitch angle ($\alpha$) to a horizontal than that of said needle movement curve.

4. The machine as defined in claim 1, wherein a distance of an intersection point of said curves from said loop-sinking points to deflection points formed by said loop-sinking points (KN, KP) corresponds to at most a double distance (needle spacing T) between two neighboring needles.

5. The machine as defined in claim 4, wherein said loop-sinking points in a driving direction of said needle movement curve (54) and said sinker movement curve (55) are precisely superposed.

6. The machine as defined in claim 5, wherein said needle movement curve and said sinker movement curve run at said sinking points over at most two needle spacings parallel to each other.

* * * * *